US005564135A

United States Patent [19]

Jones et al.

[11] Patent Number: 5,564,135

[45] Date of Patent: Oct. 15, 1996

[54] TOILET BOWL SPLASH GUARD

[76] Inventors: Clifford D. Jones; Kathleen V. Kerlin, both of 9424 Tulley Ave., Oak Lawn, Ill. 60453-2441

[21] Appl. No.: 530,473

[22] Filed: Sep. 19, 1995

[51] Int. Cl.[6] ..... E03D 9/00

[52] U.S. Cl. ..... 4/300.3

[58] Field of Search ..... 4/300.3, 661, DIG. 5

[56] References Cited

U.S. PATENT DOCUMENTS

| | | |
|---|---|---|
| 2,592,040 | 4/1952 | La Hue . |
| 2,791,780 | 5/1957 | Krischer . |
| 2,980,919 | 4/1961 | Otto et al. . |
| 3,071,778 | 1/1963 | Renshaw . |
| 3,193,845 | 7/1965 | Funk . |
| 3,914,803 | 10/1975 | Gregovski . |
| 3,931,649 | 1/1976 | Jankowski . |
| 4,060,859 | 12/1977 | Anderson . |
| 4,133,062 | 1/1979 | Fulbright . |
| 4,348,776 | 9/1982 | Sarjeant . |
| 4,612,676 | 9/1986 | Whitman . |
| 4,716,602 | 1/1988 | Brickhouse . |
| 4,912,784 | 4/1990 | Jacobson et al. . |
| 5,077,840 | 1/1992 | Masters et al. . |
| 5,117,512 | 6/1992 | Bressler . |
| 5,216,760 | 6/1993 | Brown et al. . |
| 5,276,925 | 1/1994 | Blaha . |
| 5,373,589 | 12/1994 | Rego et al. . |

*Primary Examiner*—Charles E. Phillips
*Attorney, Agent, or Firm*—Kathleen Anne Ryan

[57] ABSTRACT

A collapsible splash guard is provided that is relatively permanently secured to the lower surface of a toilet seat. The splash guard includes a base plate shaped and sized to substantially conform with the shape and size of the toilet bowl rim, a pleated, substantially U-shaped splash shield, and attachment members for attaching a first portion of the splash shield to the base plate. The splash guard also includes pivotal securing members for pivotally securing a second portion of the splash shield to the base plate and members for hingedly attaching the splash guard to the lower face of the toilet seat. The attachment members can either permanently or removable attach the first portion of the splash guard to the base plate. The splash guard can further include a flange which extends downwardly from an inner edge of the base plate such that the attachment members either permanently or removably attach the first portion of the splash shield to an inner face of the flange. The splash guard can further include a wall extending upwardly along an outer edge of the base plate. The toilet seat rests on the top surface of the upwardly extending wall when the seat is in a lowered position. The splash guard can further includes three pairs of elongate lift arm members. The first pair of elongated members is secured by hinges to the base plate. Each of the second pair of elongated lift members is hingedly secured to one of the first pair of elongated members. Each of the third pair of elongated lift members is hingedly secured to one of the second pair of elongated members and is also hingedly secured to the lower face of the seat.

21 Claims, 8 Drawing Sheets

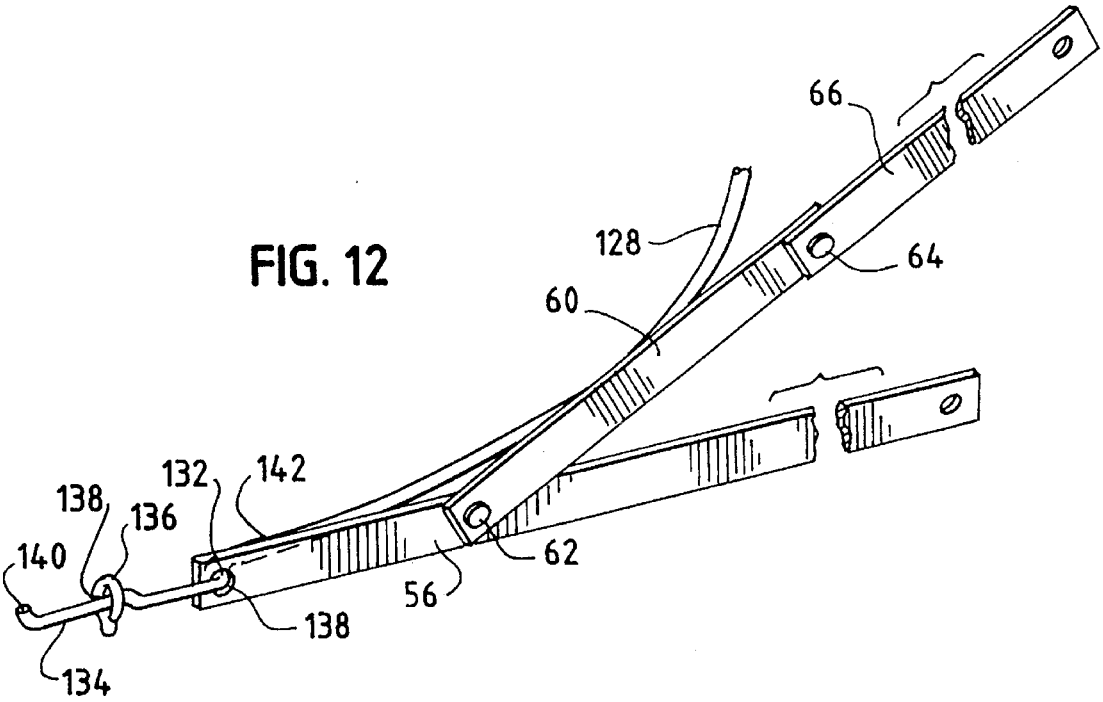
FIG. 12
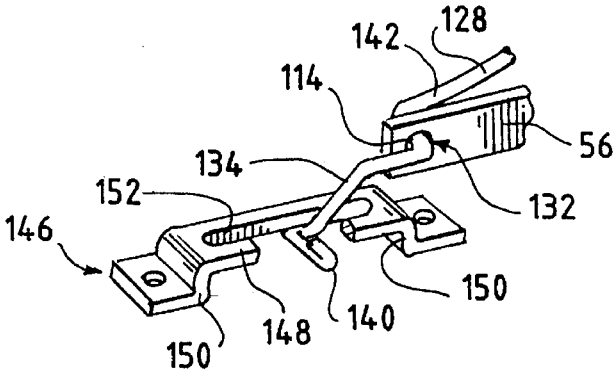
FIG. 13
FIG. 14
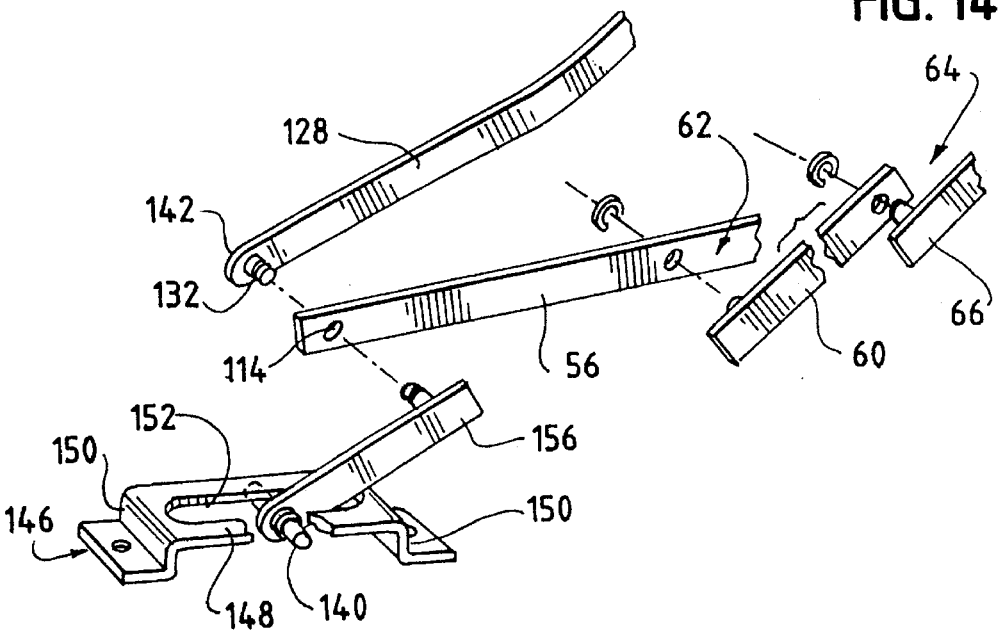

TOILET BOWL SPLASH GUARD

FIELD OF THE INVENTION

This invention relates generally to a splash guard for a toilet bowl, and, more particularly, to a splash guard for a toilet bowl which protects the rim of the toilet bowl when the toilet bowl is used as a urinal.

BACKGROUND OF THE INVENTION

Conventional toilets typically include a toilet bowl, seat, and cover. Maintaining the hygienic condition of conventional toilets that are used by both females and males, so-called uni-sex toilets, is problematic. When a male uses a conventional toilet to urinate, the seat and cover are typically raised to provide direct access to the toilet bowl. Unfortunately, in many instances such use can lead to soiling of the toilet bowl rim and perhaps the areas adjacent the toilet. The soiled toilet and adjacent areas then become unsightly and unpleasant. In some circumstances, such conventional toilets can be used heavily between cleanings thus increasing the potential for non-hygienic and unpleasant conditions. For example, male children often have difficulty using conventional toilets as urinals. The conventional toilets available in most homes are thus subject to the described-soiling problem. In addition, elderly males as well as males suffering from illnesses frequently have difficulty using conventional toilets as urinals. Consequently, the uni-sex toilets available in many hospitals and nursing homes are also subject to the described-soiling problem. However, difficulty in using a conventional toilet as a urinal is not limited to only very young males, elderly males, or males suffering from illnesses. Thus, most uni-sex toilets are subject to the described soiling problem.

Several toilet bowl splash guards have been proposed to address the soiling problem which can occur when a conventional toilet is used as a urinal. Existing toilet bowl splash guards can be generally categorized into two classes. The first class includes toilet bowl splash guards which are relatively permanently-attached to a toilet and remain attached to the toilet between uses. Examples of relatively permanently-attached toilet bowl splash guards include: Rego et al., U.S. Pat. No. 5,373,589, Fulbright, U.S. Pat. No. 4,133,062, Jacobson et al., U.S. Pat. No. 4,912,784, Anderson, U.S. Pat. No. 4,060,859, Jankowski, U.S. Pat. No. 3,931,649, Gregovski, U.S. Pat. No. 3,914,803, and Blaha, U.S. Pat. No. 5,276,925. Rego, Fulbright, and Jacobson disclose collapsible splash guards which are secured to the toilet bowl rim and to the seat of a conventional toilet. In Rego, the splash guard includes a pair of pleated shields which are secured to the bowl rim by clips and to the lower face of the seat by a modified seat bumper. The splash guard is deployed by lifting the seat. When the seat is lowered, the pleated shields are folded between the seat and the rim, and along the exterior of the rim towards the tank. In Fulbright, the splash guard includes a curved pleated splash shield which is secured to the toilet bowl rim and to the lower face of the seat by appropriate means. Fulbright further discloses an elaborate lifting apparatus which lifts the seat and seat cover above the toilet bowl to deploy the splash guard. When the seat is locked in a lowered position, the splash shield is folded within the toilet bowl along the inner surface of the rim. In Jacobson, the splash guard includes a folded splash shield which is secured by suitable means, such as adhesive or Velcro fasteners, to the rim and to the lower face of the seat in an area adjacent the hinges that secure the seat to the bowl. The splash guard is deployed by raising the seat and is folded between the seat and rim when the seat is lowered.

Anderson and Jankowski disclose collapsible splash guards which are secured to the toilet bowl rim but not to the seat. In Anderson, the splash guard includes a cylindrical pleated splash shield which is secured to the rim by brackets. The cylindrical shield includes a vertical slit which provides one type of access to the interior of the toilet bowl. A lever mechanism attached to the top of the splash shield and to a foot pedal raises the top of the shield above the rim. When the splash guard is lowered, the splash shield is folded within the toilet bowl along the inner surface of the rim. In Jankowski, the splash guard includes a substantially C-shaped splash shield which is secured to the rim by U-shaped spring clips. The spring clips raise the top of the splash shield above the rim when the seat is raised. When the seat is lowered, the shield is stored within the toilet bowl.

Gregovski discloses a toilet bowl splash guard in which the splash shield is secured to the lower surface of the seat but not to the rim. The splash shield has two side panels joined together to a horseshoe shaped rim which is attached to the lower surface of a conventional toilet seat. When the seat is raised, the side panels abut the outer side of the toilet bowl rim. When the seat is lowered, the side panels extend over the exterior sides of the toilet bowl.

Blaha discloses a collapsible splash guard shield which is used in conjunction with a modified seat cover and which includes a splash shield that is secured only to the modified seat cover. The modified seat cover includes an upper lid hingedly attached to a lower lid. The lower lid is attached to the seat by a conventional hinge. The splash shield consists of a flexible, accordion pleated tube having an open top defined by a circular upper end and a circular ring. The bottom of the splash shield is attached to the lower lid by connector means which may consist of snaps, zippers, or a hook and loop fastener. When the upper lid is raised, the circular ring moves upward slightly, above the lower lid. When the upper lid is lowered, the splash shield collapses and is sandwiched between the upper lid and the lower lid.

The above-described splash guards suffer from several disadvantages. For example, the splash guards of Fulbright, Anderson, Jankowski, and Blaha are very complicated, and therefore can be costly to manufacture. Fulbright and Blaha also require extensive modification of the toilet. Some of the splash guards, for example, Rego and Fulbright, are difficult to install and require that the seat and seat cover be unhinged from the toilet bowl during installation. In addition, some of the splash guards can be difficult to use, for example, Anderson and Blaha. Some of the splash guards do not protect a significant portion of the toilet bowl rim, for example, Jacobson and Gregovski. Moreover, some of the splash guards detract from the appearance of the toilet when the seat is in a lowered position, for example, Rego, Fulbright, and Gregovski.

The second class includes toilet bowl splash guards which are removably attached to a toilet and are removed from the toilet after each use. Examples of removably attached toilet bowl splash guards include: Whitman, U.S. Pat. No. 4,612,676, Masters et al., U.S. Pat. No. 5,077,840, Krischer, U.S. Pat. No. 2,791,780, Bressler, U.S. Pat. No. 5,117,512, Otto et al., U.S. Pat. No. 2,980,919, and Renshaw, U.S. Pat. No. 3,071,778. Whitman, Masters, and Bressler disclose splash guards that include inverted cup-like splash shields which are removably secured to toilet bowl rims. The cup-like splash shields include an aperture which provides a pathway into the toilet bowl. Bressler, Otto, and Renshaw disclose rigid, U-shaped splash shields which are removably secured to toilet bowl rims by various means, such as clips.

These removably-attached splash guards also suffer from several disadvantages. Because these splash guards do not collapse, they must be removed from the toilet before the toilet can be used with the seat in a lowered position. Consequently, storage of these splash guards between uses can lead to soiling of the storage area. And once removed, the splash guards must be reattached to the toilet when the toilet is to be used as a urinal. In some circumstances, for example, when the toilet is used by a male child, an elderly male, or a male suffering from a disease, reattaching the splash guards can require the assistance of another person. Thus, these splash guards can also be difficult to use. Moreover, some of these splash guards have relatively small openings which can also make the splash guards difficult to use, for example, Whitman, Masters, and Krischer.

A need therefore exists for an improved toilet bowl splash guard which protects the toilet bowl rim and adjacent areas from soiling when the toilet is used as a urinal.

SUMMARY OF THE INVENTION

It is an object of the invention to provide a toilet bowl splash guard which protects a large portion the toilet bowl rim from soiling when the toilet is used as a urinal.

Another object of the invention is to provide a toilet bowl splash guard which can be cost-effectively manufactured.

Another object of the invention is to provide a toilet bowl splash guard which is relatively permanently-attached to the toilet and thus does not require assistance to use.

Another object of the invention is to provide a toilet bowl splash guard which can be installed with only a minimum modification of the toilet.

Another object of the invention is to provide a toilet bowl splash guard which is relatively easy to install.

Another object of the invention is to provide a toilet bowl splash guard which does not detract from the appearance of the toilet when the toilet seat is lowered.

Another object of the invention is to provide a toilet bowl splash guard which includes a splash shield that can be removed and replaced.

These and other objectives and advantages are provided by the present invention which is a collapsible splash guard that is relatively permanently secured to the lower surface of a toilet seat. The splash guard includes a base plate shaped and sized to substantially conform with the shape and size of the toilet bowl rim. The splash guard further includes a pleated, substantially U-shaped splash shield and attachment means for attaching a first portion of the splash shield to the base plate. In addition, the splash guard includes pivotally-securing means for pivotally-securing a second portion of the splash shield to the base plate and means for hingedly securing the splash guard to the lower face of the toilet seat.

The attachment means attach a lower end of the splash shield to a lower surface of the base plate. The attachment means can either permanently attach the splash shield to the lower face of the base plate or can removably attach the splash shield to the lower face of the base plate. An alternative embodiment of the base plate further includes a flange which extends downwardly from an inner edge of the base plate. In this embodiment, the splash shield can be either permanently or removably attached to an inner face of the flange by the attachment means. The splash guard can further include a wall extending upwardly along an outer edge of the base plate. The toilet seat rests on the top surface of the upwardly extending wall when the seat is in a lowered position. Consequently, the wall helps to conceal the splash guard when the splash guard is not in use.

The splash guard can further includes three pairs of elongate lift arm members. The first pair of elongated members is secured by hinges to the base plate. Each of the second pair of elongated lift members is hingedly secured to one of the first pair of elongated members. Each of the third pair of elongated lift members is hingedly secured to one of the second pair of elongated members and is also hingedly secured to the lower face of the seat. The splash guard also includes a pleated, substantially U-shaped splash shield, attachment members for attaching the splash shield to the base plate and members which pivotally-secure the splash shield to the first pair of elongated members. When the toilet seat is raised, the three pairs of lift arm members pull on the splash shield via the pivotal members, thereby raising the splash shield above the base plate. When fully deployed, the splash shield covers and protects a large portion of the toilet rim. Moreover, the deployed splash shield provides a large target area and so is easy to use. The splash guard is installed on a toilet by simply resting the base plate on the toilet bowl rim and securing the hinges to the lower face of the toilet seat. Consequently, the toilet does not have to be disassembled to install the splash guards. In addition, the toilet needs only minimum modification to install the splash guard. Specifically, the bumpers normally found on the lower face of the seat must be removed.

The members which pivotally secure the splash shield to the first pair of elongate lift members can comprise a substantially U-shaped member secured to the upper edge of the splash shield and a pair of pivot pins extending outwardly from the U-shaped member and located opposite each other. The pivot pins extend through apertures provided in the first pair of elongate lift members to pivotally-secure the splash shield to the first pair of elongate lift members. Pin clips can also be used to further secure the pivot pins to the first pair of elongate lift members.

An alternative embodiment of the members which pivotally-secure the splash shield to the first pair of elongate lift members further includes a pair of slider arms, each of which is secured to one of the pivot pins. The slider arms extend from the pivot pins to the base plate and are slidably secured to the base plate by securing members. The securing members can comprise eyelets which are fastened to an upper surface of the base plate. Each of the slider arms extends through an aperture in one of the eyelet securing members. In an alternative embodiment, the securing members can comprise channel members which are secured to a top surface of the base plate. Retainer members affixed to the ends of the slider arms retain the slider arms within the channel members.

One embodiment of the attachment members which can removably secure the splash shield to the inner face of the flange includes a band that is secured to the lower edge of the splash shield. The band has two end segments which extend beyond the edges of the splash shield. The band further includes members that secure the band ends to each other. In one embodiment, a post extending from one of the end segments engages an aperture formed in the other end segment in snap-fit relation, somewhat like a "baseball cap" closure. When the splash shield is removably secured to both the base plate and the first pair of elongate lift arms, the splash shield can be readily removed and replaced if it becomes excessively worn or soiled.

The splash guard can also be used with a modified toilet seat that includes a substantially planar toroidal portion and a wall portion that extends downwardly from an inner edge of the toroidal portion. The wall portion of the modified seat further conceals the splash guard when the modified seat is in a lowered position. Because the splash guard is concealed by the wall portion of the base plate, and, if used, by the wall portion of the modified seat, the splash guard does not detract from the appearance of the toilet when the seat is lowered.

BRIEF DESCRIPTION OF THE DRAWINGS

FIG. 12 is a close-up, partial, exploded view of the U-shaped member and lift arms in FIGS. 10 and 11 and illustrates one embodiment of a slider arm and a securing member according to the invention;

FIG. 13 is a close-up, partial view of an alternative embodiment of a securing member according to the invention;

FIG. 14 is a close-up, partial exploded view of an alterative embodiment of a slider arm according to the invention:

DETAILED DESCRIPTION

Figure 1:
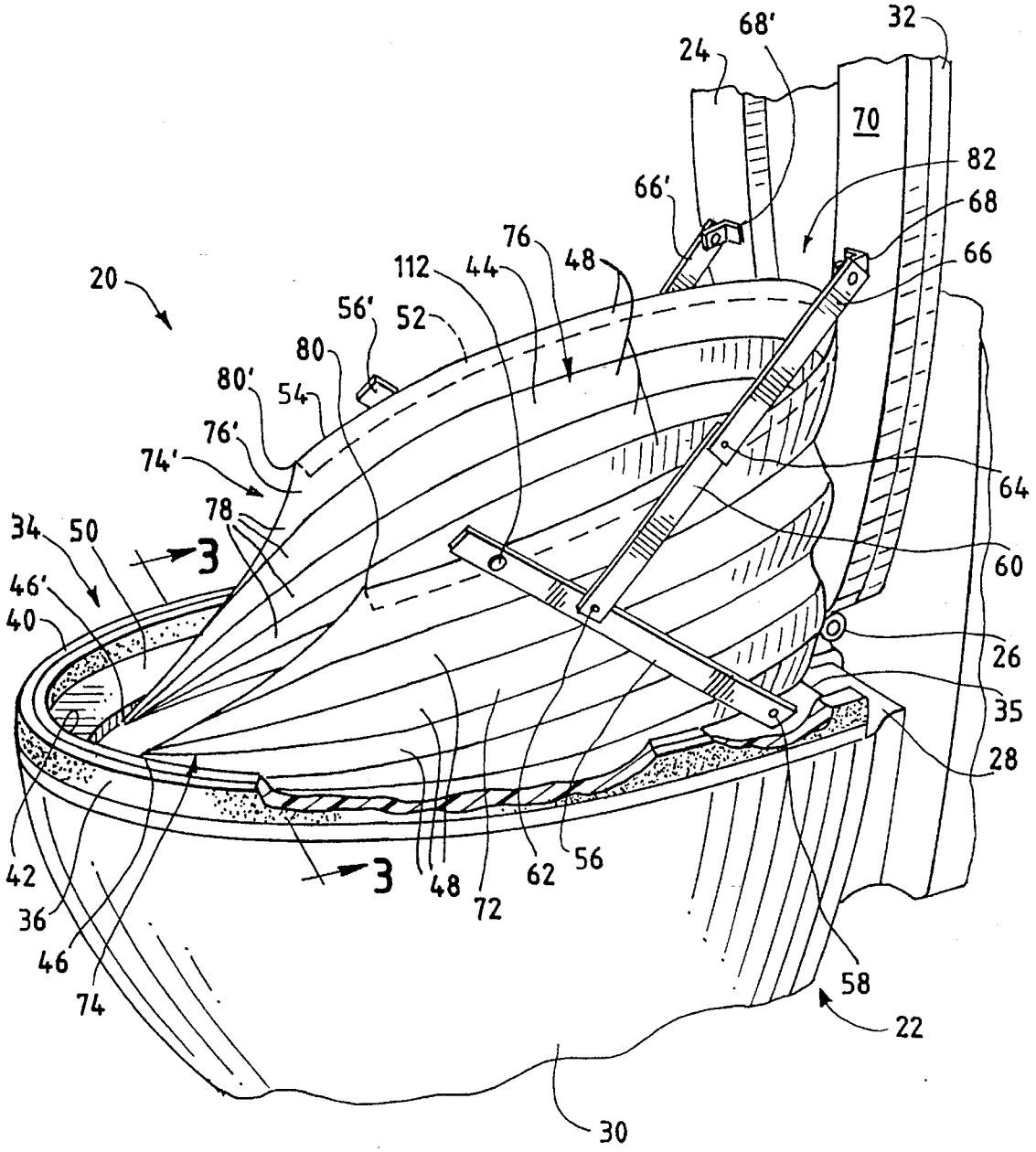
FIG. 1 is a front perspective view of a toilet bowl splash guard according to the invention.
Figure 2:
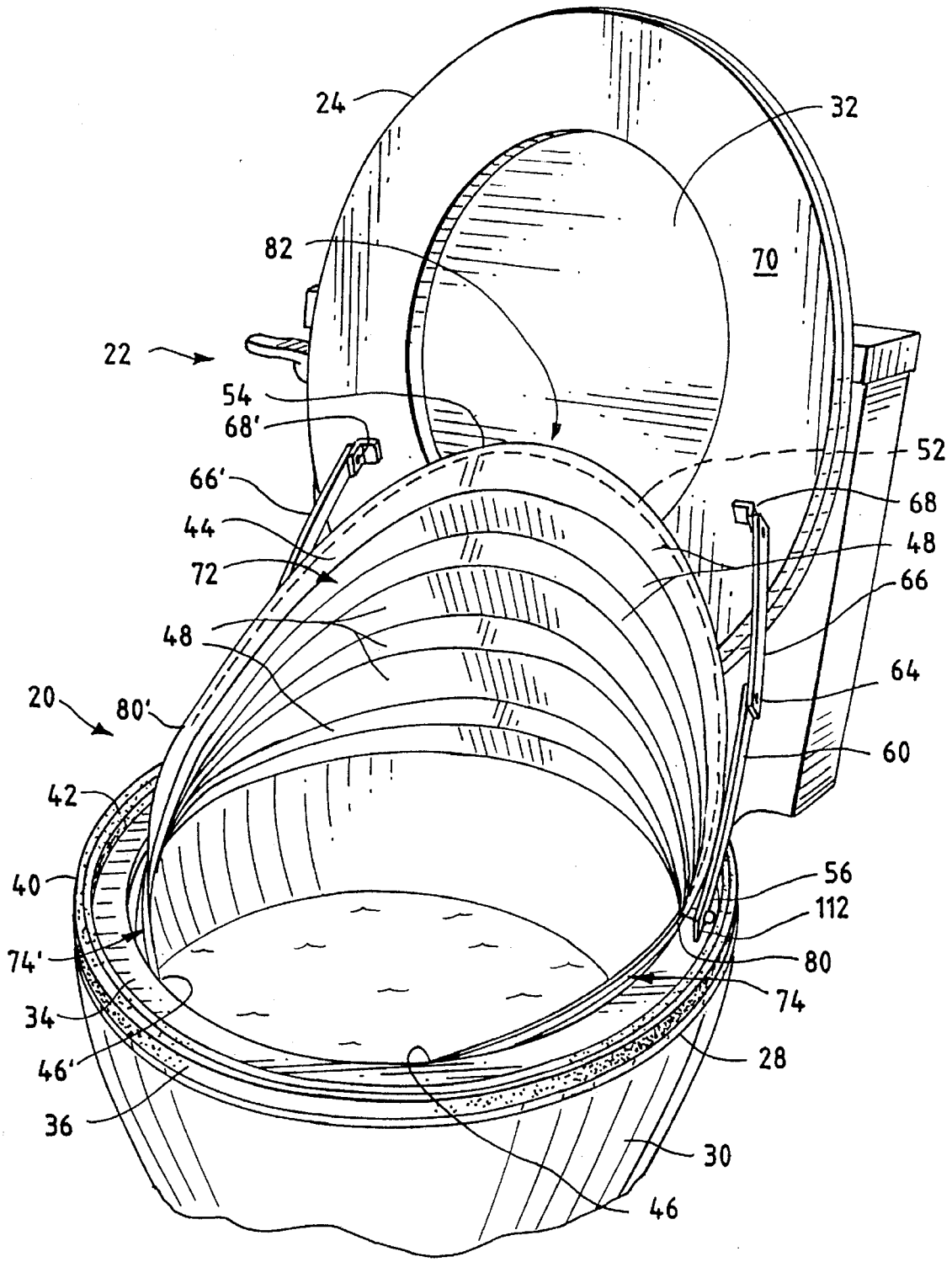
FIG. 2 is a side perspective view of the toilet bowl splash guard in FIG. 1.

In the drawings, in which like reference numbers indicate like elements throughout, FIGS. 1 and 2 illustrate the preferred embodiment of a toilet bowl splash guard 20 according to the invention. Splash guard 20 is used in conjunction with a toilet 22 having a toilet seat 24 attached by hinges 26 to the rim 28 of a toilet bowl 30. Toilet 22 can also include a seat cover 32. Splash guard 20 includes a base plate 28 which can be constructed from any suitable non-deformable material, such as plastic, wood, or metal. Base plate 34 is sized and shaped to substantially conform with the size and shape of rim 28. Base plate 34 is, however, somewhat shorter than rim 28 to accommodate hinges 26. Consequently, the back edge 35 of base plate 34 abuts hinges 26. Base plate 34 is not attached to rim 28 but merely rests on rim 28. Since base plate simply rests on rim 28 and is shorter than rim 28, base plate 34 can be installed on toilet 22 without undoing hinges 28. An upwardly extending wall 36 is affixed to the outer edge 38 of base plate 34. Wall 36 can be affixed to base plate 34 by any suitable method. For example, if base plate 34 is constructed from plastic, wall 36 can be integrally molded with base plate 34. Alternatively, wall 36 can be adhesively secured to base plate 34. Wall 36 serves several functions. First, as explained in more detail below in reference to FIG. 9, wall 36 extends between seat 24 and rim 28 when seat 24 is in a lowered position. Wall 36 thus conceals splash guard 20 when splash guard 20 is not in use. Wall 36 also takes the place of the bumpers which are usually located on the bottom surface of toilet seats. Wall 36 thus helps to cushion seat 24 when seat 24 is lowered and reduces the noise that can result from the impact of seat 24 on rim 28. The cushioning effect of wall 36 can be further enhanced by providing a cushioning layer 40, such as an elastomeric layer, on the top edge 42 of wall 36.

A generally U-shaped pleated splash shield 44 is secured to base plate 34 and extends above base plate 34 when splash guard 20 is in the raised position shown in FIGS. 1 and 2. The front edges 46 and 46' of splash shield 44 are separated from each other by a minimal distance on the order of about three to four inches. Splash shield thus covers and protects almost all of rim 28, as best shown in FIG. 2. The pleats 48 are formed to conform with the shape of base plate 34. Each individual pleat 48 is somewhat more shallow than base plate 34. Consequently, when seat 24 is lowered, shield 44 is folded along pleats 48 and rests on the top surface 50 of base plate 34. Shield 44 can be made from any suitable, liquid-impermeable material and is preferably made from a strong, light weight plastic. A rigid, substantially U-shaped member 52 is secured to shield 44 along the top edge 54 of shield 44. U-shaped member 52 can be enveloped within a channel formed along top edge 54. Alternatively, top edge 54 can be adhesively secured to U-shaped member 52. U-shaped member 52 reinforces top edge 54 to prevent wear and tear to top edge 54. U-shaped member 52 also acts in conjunction with the lifting mechanism to raise shield 44 above base plate 34. The lifting mechanism includes a first pair of elongated lift arms 56 and 56' which are secured by hinges 58 and 58' (shown in FIGS. 9–11) to base plate 34. Hinges 58 and 58' can be secured to base plate 34 by any suitable method. For example, if base plate 34 is constructed from plastic, hinges 58 and 58' can be integrally molded with base plate 34. Alternatively, hinges 58 and 58' can be secured to base plate 34 by screws, rivets, and other comparable fasteners. As explained in more detail with reference to FIGS. 8 and 9, lift arms 56 and 56' are also pivotally-secured to U-shaped member 52. A second pair of elongated lift arms 60 and 60' (60 ' is shown in FIG. 11 ) are secured by hinges 62 and 62' to lift arms 56 and 56' intermediate hinges 58 and 58' and U-shaped member 52. Lift arms 60 and 60' are also secured by hinges 64 and 64' (64' is shown in FIG. 11) to a third pair of elongated lift arms 66 and 66'. Lift arms 66 and 66' are also secured by hinges 68 and 68' to the lower face 70 of seat 24. Hinges 68 and 68' are attached to face 70 by any suitable method, such as screws. Lift arms 56.56', 60, 60', 66, and 66' can be constructed from any suitable rigid material, such as plastic. Lift arms 56.56', 60, 60', 66, and 66' can also be slightly curved (as best shown in FIG. 9) to conform to the shape of base plate 34 and shield 44.

In the preferred embodiment shown in FIGS. 1 and 2, shield 44 includes three pleated sections, 72, 74, and 74'. Pleated section 72 forms the majority of shield 44 and is substantially-U-shaped to conform with the shape of base plate 34. Pleated section 72 extends slightly beyond the junctures between shield 44 and lift arms 56 and 56'. The pleats 48 in section 72 are preferably parallel to each other. Pleated sections 74 and 74' extend from the front edges 76 of section 72 to base plate 34. The pleats 78 in sections 74 and 74' converge toward the front edges 46 and 46' of shield 44. The vertical displacement of the front edges 80 and 80' of U-shaped member 52 is thus limited by the extension limits of pleats 78.

Figure 3:
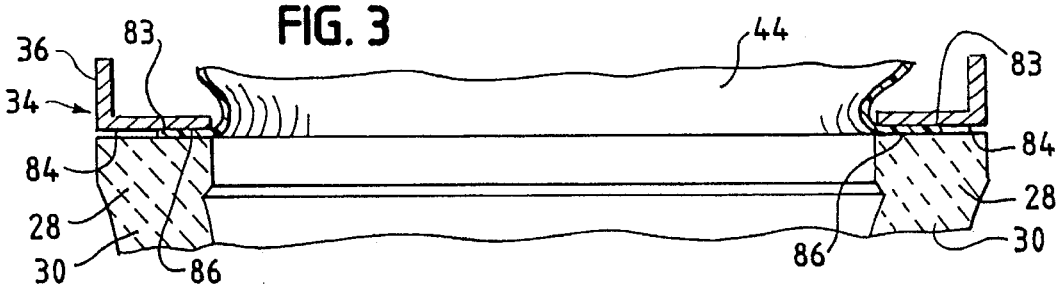
FIG. 3 is a cross sectional view along line 3—3 in FIG. 1.
Figure 4:
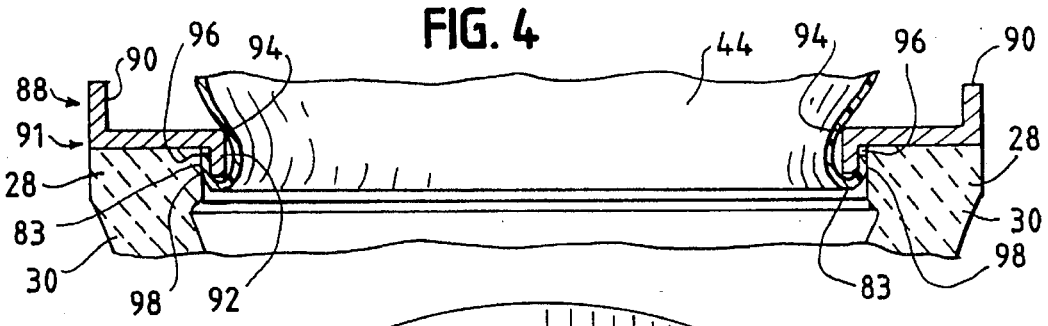
FIG. 4 is the same view as FIG. 3 and shows an alternative embodiment of the splash guard base plate.
Figure 5:
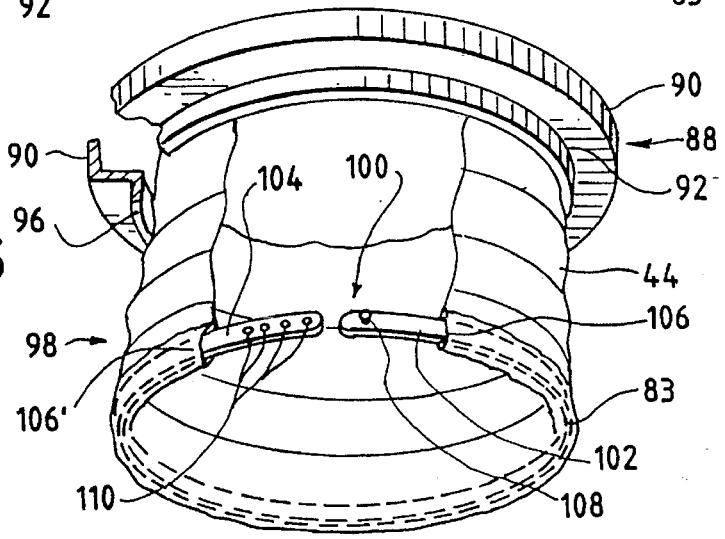
FIG. 5 is an exploded perspective view of the splash guard base plate and splash shield FIG. 4.
Figure 6:
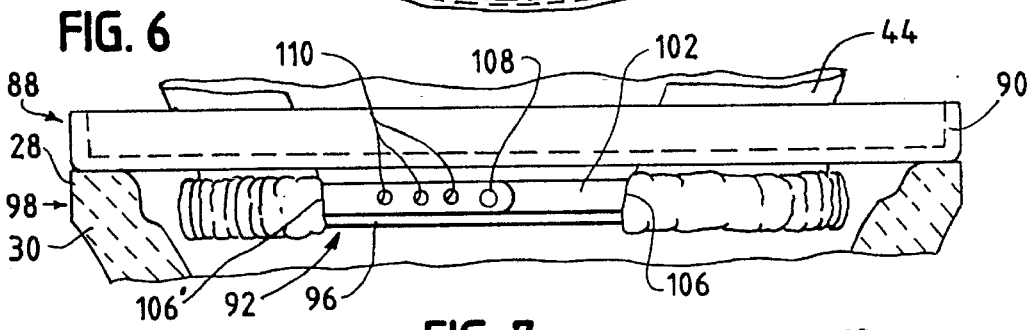
FIG. 6, is a partial, cut-away front perspective view of the splash guard base plate and shield in FIG. 4 resting on a toilet bowl rim.
Figure 7:
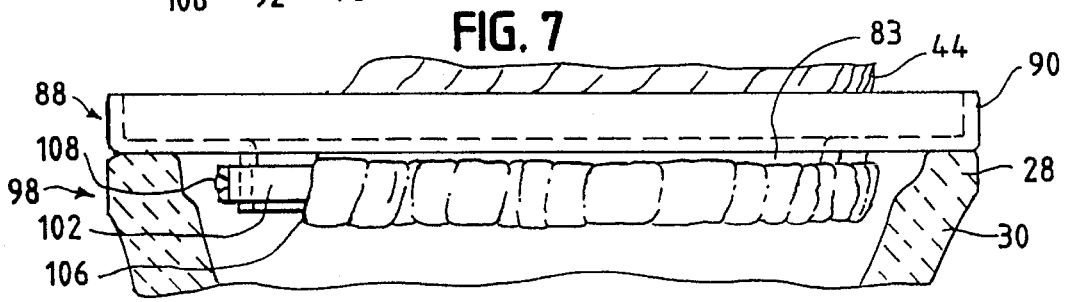
FIG. 7 is a partial, cut-away side perspective view of the splash guard base plate and shield in FIG. 4 resting on a toilet bowl rim.

FIGS. 3–7 illustrate various ways in which shield 44 can be secured to base plate 34. In one embodiment, shown in FIG. 3, the lower end 83 of shield 44 is attached to the lower face 84 of base plate 34 by attachment members 86. Shield 44 can be either permanently secured or removably secured to face 84. When the lower end 83 of shield 44 is permanently secured to face 84, attachment members 86 can be any suitable permanent fasteners, such as screws, rivets, or adhesive. Alternatively, when shield 44 is removably secured to lace 84, attachment members 86 can be any suitable releasable fasteners, such as Velcro fasteners. FIG. 4 illustrates an alternative base plate 88 that can be used with shield 44. Like base plate 34, base plate 88 is sized and shaped to conform with toilet bowl rim 28 and includes a wall 90 that extends upwardly along an outer edge 91 of base plate 88. Base plate 88 further includes an annular flange 92 that extends downward from an inner edge 94 of base plate 88 into toilet bowl 30. Flange 92 serves at least two purposes. First, flange 92 helps to hold base plate 88 in position on toilet bowl rim 28. Second, in this embodiment shield 44 is either permanently secured or removably secured to the inner face 96 of flange 92 by attachment members 98. When the lower end 83 of shield 44 is permanently secured to face 96, attachment members 98 can be any suitable permanent fasteners, such as screws, rivets, or adhesive. Alternatively, when shield 44 is removably secured to face 96, attachment members 98 can be any suitable releasable fasteners, such as Velcro fasteners or a rubber band. FIGS. 5 and 6 illustrate a preferred embodiment of attachment members 98. In this embodiment, attachment members 98 consist of a deformable band 100 that is secured to lower end 83 of shield 44. Band 100 can be secured to lower end 83 by any suitable method, such as adhesive. Alternatively, band 100 can be partially enveloped within a channel formed along lower end 83. Band 100 includes two front extensions 102, 104 which extend beyond the front edges 106, 106' of lower end 83. Extension 102 includes a cylindrical post 108 which is sized to be snap-fitted through apertures 110 formed in extension 104. Shield 44 is removably secured to flange 96 by folding lower end 83 of shield 44 along inner face 96 and then snap-fitting post 100 through one of the apertures 110. Extensions, 102 and 104, along with post 100 and apertures 110 thus form a "baseball-cap" type attachment to flange 96.

Figure 8:
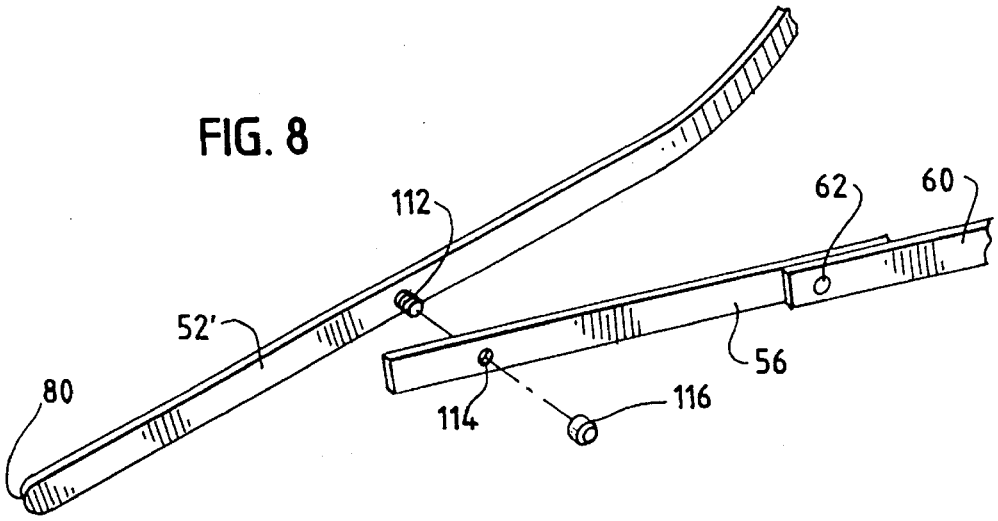
FIG. 8 is a close-up, partial exploded view of the U-shaped member and one of the lift arms in FIGS. 1 and 2.
Figure 9:
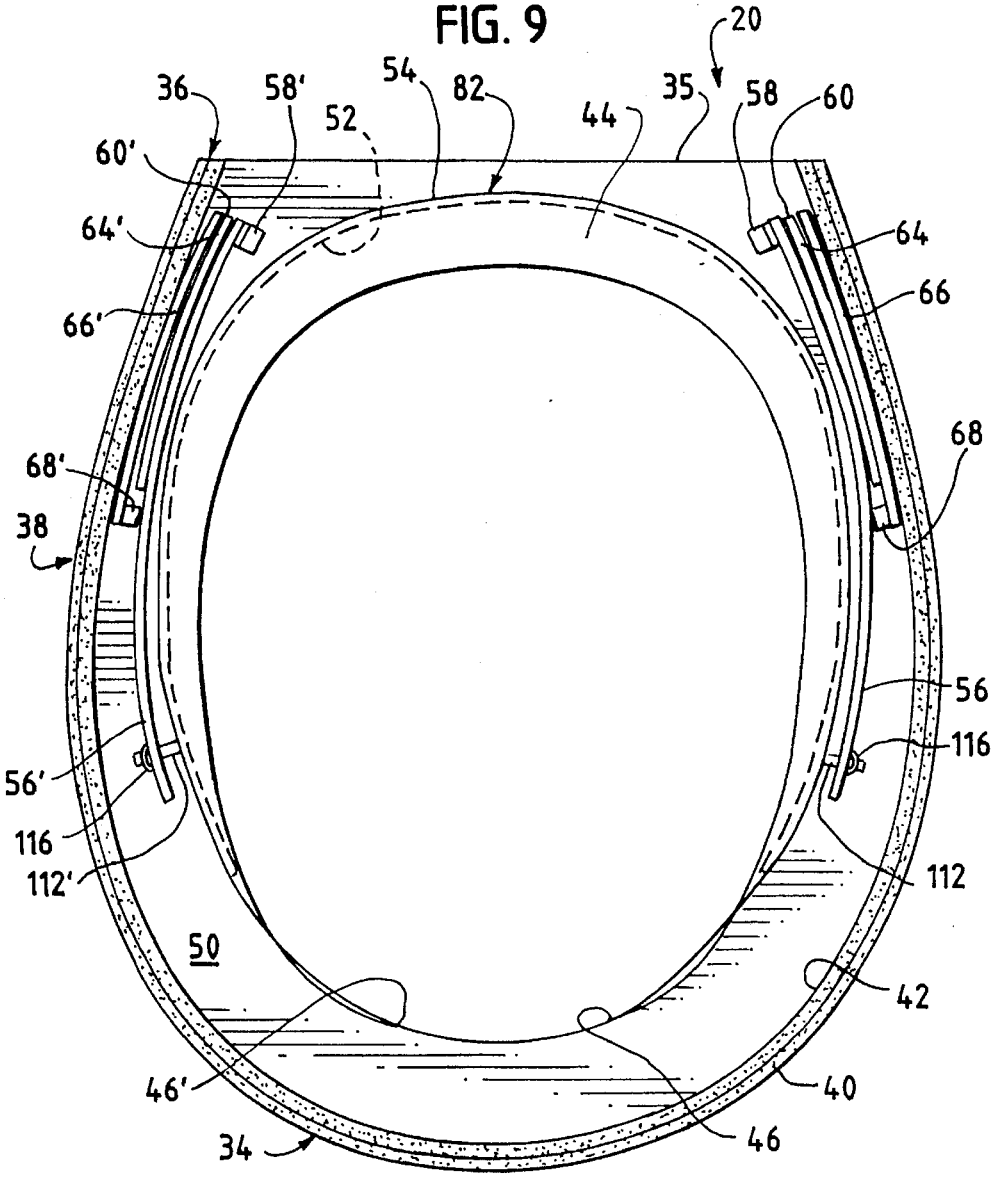
FIG. 9 is a top perspective view of the splash guard in FIG. 1, in a folded configuration for storage.

As shown in FIGS. 8 and 9, a preferred embodiment of U-shaped member 52 includes a pair of pivot pins 112, 112' which extend outwardly from U-shaped member 52 and are located substantially opposite each other. Pivot pins 112, 112' are sized and shaped to extend through pivot apertures 114 formed in lift arms 56 and 56'. Pin clamps 116 can be used to further secure pins 112, 112' within apertures 114. Pins 112 and 112' can be pushed back through apertures 114 to release shield 44 from lift arms 56 and 56' Pins 112, 112' thus removably secure shield 44 to lift arms 56, 56'. The combination of pivot pins 112, 112' and releasable attachment members 86 or 98 permit shield 44 to be removed from guard 20. Consequently, shield 44 can be readily removed and replaced if it becomes excessively soiled or worn. Moreover, because attachment members 86 are located on the bottom surface 84 of base plate 34, attachment members 86 are generally protected from soiling. Similarly, attachment members 98 are also protected against soiling because they are positioned along the inner face 96 of flange 92. Thus, shield 44 can be removed in a hygienic manner.

FIG. 9 shows the configuration of splash guard 20 when guard 20 is in a folded configuration for storage, for example, when seat 24 (not shown) is in a lowered position. In this folded configuration, pleated section 72 is folded on itself and rests primarily on top surface 50 of base plate 34. Pleated sections 74 and 74' are also folded on themselves and extend from top surface 50 to lower face 83 of base plate 34 (as best seen in FIGS. 3 and 4). Lift arms 56, 56', 60, 60', 66, and 66' are positioned on top surface 50 of base plate 34, intermediate shield 44 and wall 36. When seat 24 is lowered to place guard 20 in the folded configuration shown in FIG. 9, seat 23 rests on top edge 42 of wall 36. Consequently, wall 36 conceals guard 20 along the exterior of toilet 22 when guard 20 is not in use. Moreover, only a small portion of shield 44 is visible along the inner surface of rim 28 when guard 20 is folded. Splash guard 20 is therefore substantially concealed when not in use and so does not detract from the appearance of toilet 22.

In use, raising seat 24 raises lift arms 66, 66' and 60, 60' from their stored position. As arms 66 and 60 are raised, arms 60, 60' pull on arms 56, 56', which rise above base plate 34 until they reach the maximum vertical displacement allowed by pleated sections 74, and 74'. At this point, further raising of seat 24 and arms 66, 66', 60, and 60' causes U-shaped member 52 to pivot on pivot pins 112, 112' so that the back portion 82 of shield 44 is raised further above base plate 34 than are the front edges 80 and 80' of U-shaped member 52. Thus, when shield 44 is fully deployed, as shown in FIG. 1, back portion 82 is somewhat higher than front edges 80 and 80'. Splash guard 20 therefore provides a large target area and so is easily used.

Figure 10:
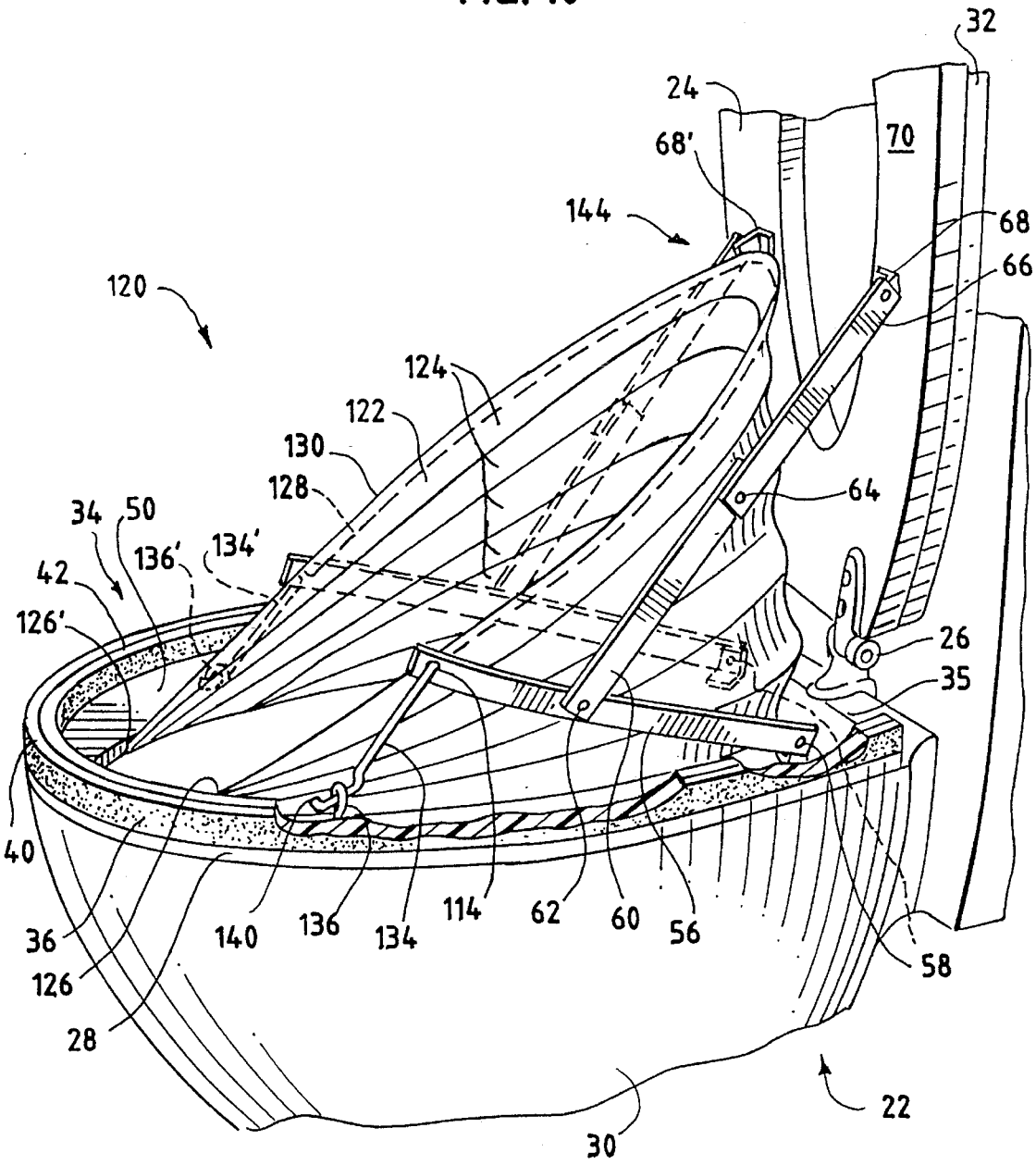
FIG. 10 is a partially cut-away side perspective view of an alterative embodiment of a splash guard according to the invention.
Figure 11:
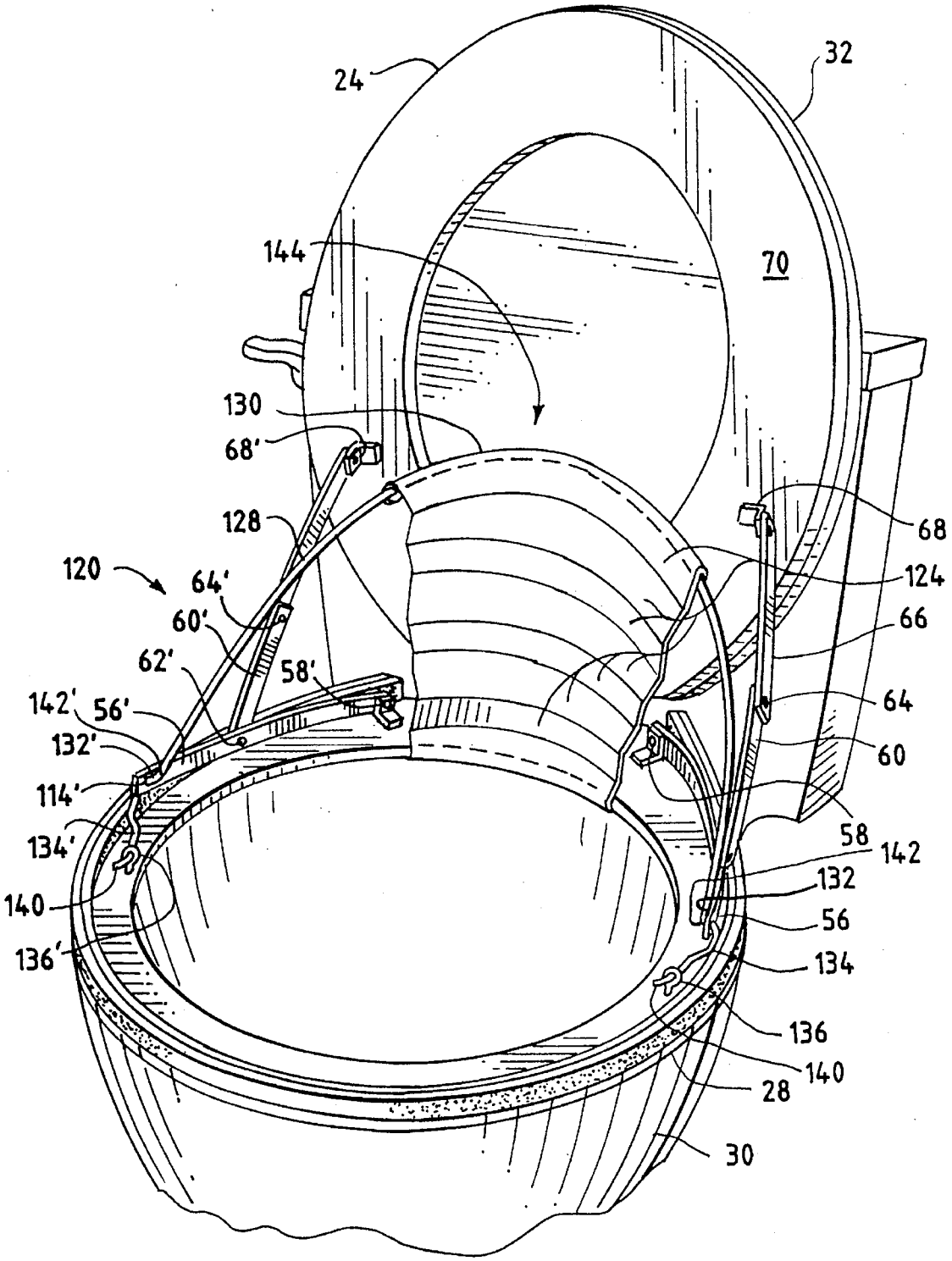
FIG. 11. is a partially cut-away front perspective view of the splash guard in FIG. 10.

FIGS. 10 and 11 show an alternative embodiment of a splash guard 120 according to the invention. Splash guard 120 differs from splash guard 20 primarily in the configuration of the splash shield 122 and in the manner in which shield 122 is pivotally-secured to lift arms 56 and 56'. Unlike shield 44, shield 122 has only one pleated section in which the pleats 124 converge toward the front ends 126, 126' of shield 122. In addition, the U-shaped member 128, which is secured along the top edge 130 of shield 122, does not extend appreciably beyond the front end of arms 56 and 56'. Pivot pins 132, 132' are secured to the front ends 142 of U-shaped member 130 and are sized and shaped to extend through the pivot apertures 114, 114' formed in lift arms 56 and 56'. Unlike guard 20, guard 120 further includes a pair of slider arms 134 and 134' which are secured to pivot pins 132, 132' and extend from pivot pins 132, 132' towards base plate 34. In addition, guard 120 includes securing members 136 and 136' which slidably secure slider arms 134 and 134' to base plate 34. FIG. 12 shows slider arm 134 and securing member 136 in more detail. In the embodiment shown in FIG. 12, securing member 136 is an eyelet which can been screwed to the top surface 50 of base plate 34. Slider arm 134 extends from pivot pin 132 toward securing eyelet 136 and through an aperture 138 formed in securing eyelet 136. An end portion 140 of slider arm 134 is angularly disposed to slider arm 134 to retain slider arm within aperture 138. When toilet seat 24 is raised to deploy splash guard 120, lift arm 56 pulls on slider arm 134 and causes it to slide backwards within aperture 138. In so doing, shield 122 begins to rise vertically, above base plate 34. When slider arm 134 has moved sufficiently so that end portion 140 is adjacent securing eyelet 136, the front ends 142 and 142' of U-shaped member 128 are constrained and cannot rise any further. Consequently, when lift arm 56 pulls further on slider arm 134, U-shaped member 128 pivots on pivot pins 132, 132' thereby causing the back portion 144 of shield 122 to rise further above front ends 142, as best seen in FIGS. 10 and 11.

FIG. 13 illustrates an alternative embodiment of a securing member 146. In this embodiment, securing member 146 is a channel member which is secured to top surface 50 of base plate 34. Securing channel member 146 includes a top portion 148 which extends between vertical side walls 150, 150' and which is located above top surface 50. A channel 152 is formed in top portion 148, between side walls 150. Slider arm 134 extends through channel 152 and is retained within channel 152 by end portion 140. When toilet seat 24 is raised to deploy splash guard 120, lift arm 56 pulls on slider arm 134 and causes it to slide backwards within channel 152. In so doing, shield 122 begins to rise vertically, above base plate 34. When slider arm 134 has moved sufficiently so that end portion 140 is adjacent a side wall 150, the front ends 142 and 142' of U-shaped member 128 are constrained and cannot rise any further. Consequently, when lift arm 56 pulls further on slider arm 134, U-shaped member 128 pivots on pivot pins 132, 132' thereby causing the back portion 144 of shield 126 to rise further above front ends 142, as shown in FIGS. 10 and 11.

FIG. 14 illustrates an alternative embodiment of a slider arm 156. In this embodiment, slider arm 156 includes a hollow, cylindrical member 158 sized to engage pivot-pin 132 in snap-fit relation. Shield 122 can therefore be released from its engagement with lift arm 56 by snapping pivot pin 132 out of cylindrical member 158. Cylindrical member thus removably secures pivot pin 132 to lift arm 56. The combination of pivot pin 132, cylindrical member 158, and releasable attachment members 86 or 98 permit shield 122 to be removed from guard 120. Consequently, shield 122 can be readily removed and replaced if it becomes excessively soiled or worn.

Figure 15:
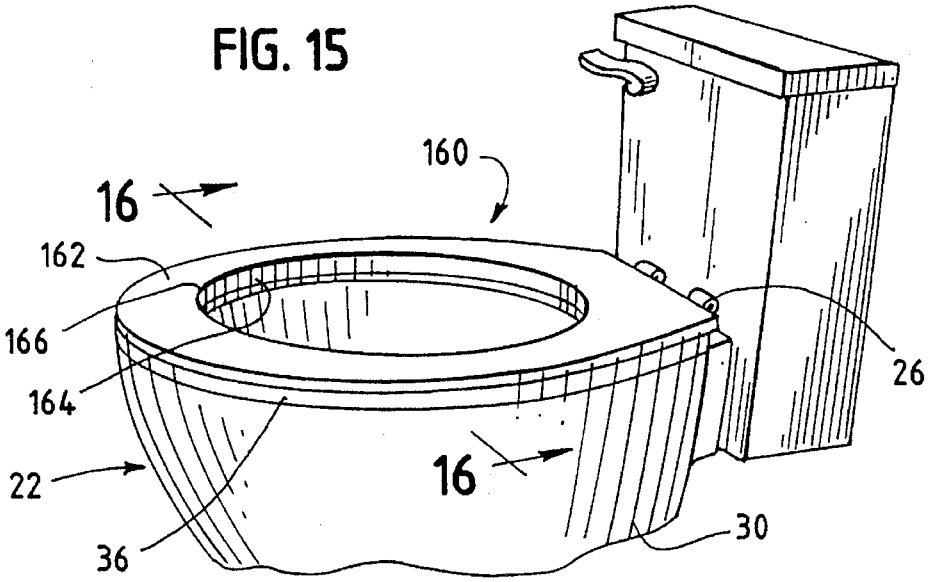
FIG. 15 is a partial, side perspective view of a modified seat used in conjunction with either the base plate and splash shield in FIG. 3 or the base plate and splash shield in FIG. 4.
Figure 16:
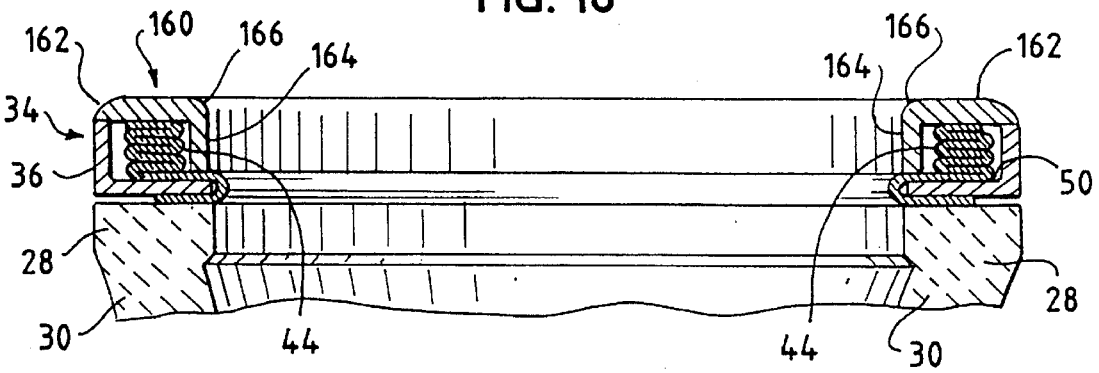
FIG. 16 is a cross section along line 16—16 in FIG. 15, showing the modified seat used in conjunction with the base plate and splash shield of FIG. 6.
Figure 17:
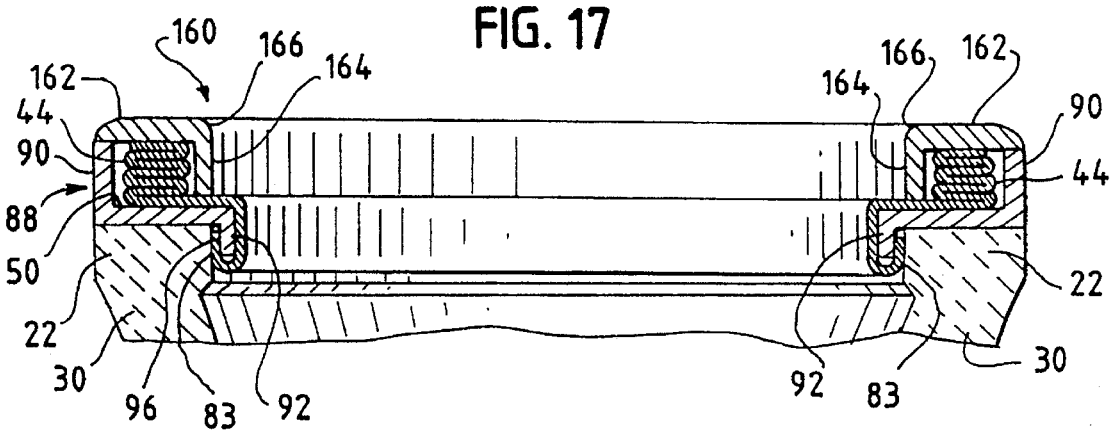
FIG. 17 is the same view as FIG. 16, showing the modified seat used in conjunction with the base plate and splash shield of FIG. 7.

FIGS. 15–17 illustrate a modified toilet seat 160 which can be used in conjunction with either base plate 34 or base plate 88. Seat 160 includes a generally planar toroidal portion 162 and a wall portion 164 that extends downwardly from an inner edge 166 of the toroidal portion 162. Wall portion 164 is somewhat shorter than upwardly extending wall 36. Consequently, as shown in FIG. 16, wall portion 164 terminates above top surface 50 of base plate 34. When modified seat 160 is lowered onto base plate 34, wall portion 160 conceals shield 44 along the interior of toilet bowl 30 thereby further enhancing the appearance of toilet 22 when shield 44 is not in use. Wall portion 164 also protects shield 44 from soiling when toilet 22 is used with seat 160 in a lowered position. Modified seat 160 interacts with base plate 88 in a similar fashion and conceals and protects shield 44 when toilet 22 is used with seat 160 in a lowered position. Although not shown, modified seat 160 can also be used in conjunction with shield 122.

Splash guards 20 and 120 offer considerable advantages over existing toilet bowl splash guards. Splash guards 20 and 120 are installed on toilet 22 by simply resting base plate 34 or base plate 88 on toilet bowl rim 28 and securing hinges 68 and 68' to the lower face 70 of seat 24. Consequently, toilet 22 does not have to be disassembled, for example, by undoing hinges 68, 68', to install splash guards 20 and 120. In addition, toilet 22 needs only minimum modification to install splash guards 20 and 120. Specifically, the bumpers normally found on lower face 70 of seat 24 must be removed. However, when modified, seat 24 behaves in substantially the same manner as it would if it had bumpers because upwardly extending walls 36 or 90 cushion the impact of seat 24 and support seat 24. Walls 36 and 90 also conceal splash guards 20 and 120 along the exterior of toilet 22 when seat 24 is in a lowered position. Splash guards 20 and 120 thus do not detract from the appearance of toilet 22 when seat 24 is lowered. Moreover, if splash guards 20 and 120 are used with modified seat 160, splash guards 20 and 120 are further concealed by downwardly extending wall 164 when modified seat 160 is in a lowered position. However, when either seat 24 or modified seat 160 is raised, splash shield 44 of guard 20 covers and protects a large portion of rim 28, as does shield 122 of splash guard 120. In addition, both shield 44 and shield 122 provide a large target area when they are deployed. Splash guards 20 and 120 are therefore easy to use. And because splash guards 20 and 120 remain attached to toilet 22 between uses, splash guards do not require assistance to use. Splash shields 44 and 122 can also be removably secured to lift arms 56 and 56' and to either base plate 34 or base plate 88. Consequently, splash shields 44 and 122 can be removed and replaced if they become excessively worn or soiled. And because splash shields 44 and 122 are secured to either the lower face of base plate 24 or the inner face 96 of flange 92 of base plate 88, splash shields 44 and 122 can be removed and replaced in a hygienic manner. Splash guards 20 and 120 can also be cost-effectively manufactured because they include a minimum of relatively simple components.

Whereas the present invention has been described with respect to specific embodiments thereof, it will be understood that various changes and modifications will be suggested to one skilled in the art and it is intended that the invention encompass such changes and modifications as fall within the scope of the appended claims.

What is claimed is:

1. A toilet bowl splash guard for use with a toliet that includes a seat attached by hinges to a toilet bowl, the seat having a lower face, the toilet bowl having an upper, annular toilet bowl rim, said toilet bowl splash guard comprising:

a base plate shaped and sized to substantially conform with the shape and size of the toilet bowl rim, said base plate having an annular flange extending downwardly from an inner edge of said base plate;

a pleated, substantially U-shaped splash shield attachment means for attaching a first portion of said splash shield to said base plate;

pivotal securing means for pivotally-securing a second portion of said splash shield to said base plate; and means for hingedly-securing said splash guard to the lower face of the seat;

wherein said first portion of said splash shield comprises a lower end of said splash shield and wherein said attachment means attach said lower end of said splash guard to an inner face of said annular flange.

2. The toilet bowl splash guard of claim 1 further comprising a wall portion extending upwardly along an outer edge of said base plate.

3. The toilet bowl splash guard of claim 1 wherein said attachment means is a removable attachment.

4. A toilet bowl splash guard for use with a toilet that includes a seat attached by hinges to a toilet bowl, the seat having a lower face, the toilet bowl having an upper, annular toilet bowl rim, said toilet bowl splash guard comprising:

a base plate shaped and sized to substantially conform with the shape and size of the toilet bowl rim;

a wall portion extending upwardly along an outer edge of said base plate;

a first pair of elongated members hingedly secured to said base plate;

a second pair of elongated members, each of said second pair of elongated members being hingedly secured to one of said first pair of elongated members;

a third pair of elongated members, each of said third pair of elongated members being hingedly secured to one of said second pair of elongated members and each of said third pair of elongated members being hingedly secured to the lower face of the seat;

a pleated, substantially U-shaped splash shield:

attachment means for attaching said splash shield to said base plate; and means for pivotally-securing said splash shield to said first pair of elongated members.

5. The toilet bowl splash guard of claim 4 wherein said means for pivotally-securing said splash shield to said first pair of elongated members comprises a substantially U-shaped member secured to an upper edge of said splash shield, a first pin extending outwardly from said U-shaped member and through an aperture in one of said first pair of elongated members, a second pin positioned substantially opposite said first pin and extending outwardly from said U-shaped member and through an aperture in the other of said first pair of elongated members.

6. The toilet bowl splash guard of claim 5 further comprising means for securing said first and second pins to said first pair of elongated members.

7. The toilet bowl splash guard of claim 5 wherein said means for pivotally-securing said splash shield to said first elongated member further comprises a first arm secured to said first pin and extending from said first pin toward said base plate, a second arm secured to said second pin and extending toward said base plate, and means for slidably securing said first and second arms to said base plate.

8. The toilet bowl splash guard of claim 7 wherein said means for slidably securing said first and second arms to said base plate comprises first and second upwardly extending eyelets secured to said base plate, said second eyelet being positioned substantially opposite said first eyelet, said first eyelet including an aperture through which said first arm extends, and said second eyelet including an aperture through which said second arm extends.

9. The toilet bowl splash guard of claim 7 wherein said means for slidably securing said first and second arms to said base plate comprises first and second channel members secured to said base plate, said second channel member being positioned substantially opposite said first channel member, and wherein said first arm further comprises a retainer member secured to one end of said first arm and said second arm further comprises a retainer member secured to one end of said second arm, said first channel member slidably retaining said first retainer member and said second channel member slidably retaining said second retainer member.

10. The toilet bowl splash guard of claim 4 wherein said attachment means attaches a lower end of said splash shield to a lower face of said base plate.

11. The toilet bowl splash guard of claim 4 wherein said attachment means removably attaches a lower end of said splash shield to a lower face of said base plate.

12. The toilet bowl splash guard of claim 4 wherein said base plate further comprises an annular flange extending downwardly from an inner edge of said base plate.

13. The toilet bowl splash guard of claim 12 wherein said attachment means attaches a lower end of said splash guard to an inner face of said annular flange.

14. The toilet bowl splash guard of claim 12 wherein said attachment means removably attaches a lower end of said splash guard to an inner face of said annular flange.

15. The toilet bowl splash guard of claim 14 wherein said attachment means comprises a band member secured to said lower end of said splash guard, said band member having first and second ends, and means for securing said first end to said second end around said annular flange.

16. A toilet bowl splash guard for use with a toilet that includes a seat attached by hinges to a toilet bowl, the seat having a lower face, the toilet bowl having an upper, annular toilet bowl rim, said toilet bowl splash guard comprising:

a base plate shaped and sized to substantially conform with the shape and size of the toilet bowl rim;

a wall portion extending upwardly along an outer edge of said base plate;

a first pair of elongated members hingedly secured to said base plate;

a second pair of elongated members, each of said second pair of elongated members being hingedly secured to one of said first pair of elongated members;

a third pair of elongated members, each of said third pair of elongated members being hingedly secured to one of said second pair of elongated members and each of said third pair of elongated members being hingedly secured to the lower face of the seat;

a pleated, substantially U-shaped splash shield;

a substantially U-shaped member secured to an upper edge of said splash shield; and means for pivotally-securing said U-shaped member to said first pair of elongated members.

17. The toilet bowl splash guard of claim 16 wherein a lower end of splash shield is attached to a lower face of said base plate.

18. The toilet bowl splash guard of claim 16 wherein a lower end of said splash shield is removably attached to a lower face of said base plate.

19. A toilet bowl splash guard for use with a toilet that includes a seat attached by hinges to a toilet bowl, the seat having a lower face, the toilet bowl having an upper, annular toilet bowl rim, said toilet bowl splash guard comprising:

a base plate shaped and sized to substantially conform with the shape and size of the toilet bowl rim;

a wall portion extending upwardly along an outer edge of said base plate;

an annular flange extending downwardly along an inner edge of said base plate;

a first pair of elongated members hingedly secured to said base plate;

a second pair of elongated members, each of said second pair of elongated members being hingedly secured to one of said first pair of elongated members;

a third pair of elongated members, each of said third pair of elongated members being hingedly secured to one of said second pair of elongated members and each of said third pair of elongated members being hingedly secured to the lower face of the seat;

a pleated, substantially U-shaped splash shield;

a substantially U-shaped member secured to an upper edge of said splash shield; and means for pivotally-securing said U-shaped member to said first pair of elongated members.

20. The toilet bowl splash guard of claim 19 wherein a lower end of said splash shield is attached to said annular flange.

21. The toilet bowl splash guard of claim 19 wherein a lower end of splash shield is removably attached to said annular flange.

* * * * *